United States Patent [19]

Mitchell

[11] Patent Number: 4,483,353

[45] Date of Patent: Nov. 20, 1984

[54] TOBACCO PROCESSING

[75] Inventor: Terence G. Mitchell, Hampshire, England

[73] Assignee: British-American Tobacco Company Limited, London, England

[21] Appl. No.: 399,227

[22] Filed: Jul. 19, 1982

[30] Foreign Application Priority Data

Jul. 24, 1981 [GB] United Kingdom ..... 8122815

[51] Int. Cl.[3] ..... A24B 15/20; A24B 15/24

[52] U.S. Cl. ..... 131/297; 131/307; 131/308; 131/310

[58] Field of Search ..... 131/297, 298, 307, 308, 131/309, 310, 290

[56] References Cited

U.S. PATENT DOCUMENTS

| | | | |
|---|---|---|---|
| 4,343,317 | 8/1982 | Bokelman | 131/297 |
| 4,347,859 | 9/1982 | Bokelman et al. | 131/307 |
| 4,355,648 | 10/1982 | Bokelman et al. | 131/307 |

*Primary Examiner*—Vincent Millin

*Attorney, Agent, or Firm*—Kane, Dalsimer, Kane, Sullivan and Kurucz

[57] ABSTRACT

A tobacco-treatment process comprises mechanically expressing cell-sap from yellowed, substantially undried, tobacco-leaf material, impregnating the fibrous material remaining after the expression with said cell-sap or with parts or components of said cell-sap or with cell-sap expressed from other yellowed, substantially undried, tobacco leaf material, and drying the sap-impregnated material. The tobacco leaf material may comprise leaves harvested in a fully developed and mature state. The leaves may be at least partly yellow when harvested. They may have been yellowed by the application of a yellowing agent to tobacco plants or yellowing may have been effected or completed by heaping or rack-hanging the harvested leaves in an enclosed atmosphere, suitably with a relative humidity of 70% or more and a temperature in the range of 20° to 40° C. Ethylene gas may be introduced into the atmosphere to promote the yellowing. The tobacco leaf material may be cut before being subjected to cell-sap expression. The expression may be effected in at least two stages, suitably a first stage in which the mid ribs of the tobacco leaves are crushed and a second stage in which the cell-sap is expressed from the lamina portions of the leaves. Before the impregnation with cell-sap, the sap, or parts or components thereof, may be subjected to a fractionating process to reduce the content therein of one or more constituent compounds. Before the sap expression, an antioxidant may be added to the leaf material or an antioxidant may be added to the cell-sap or parts or components thereof. An enzyme may be added to the cell-sap or parts or components thereof.

15 Claims, 1 Drawing Figure

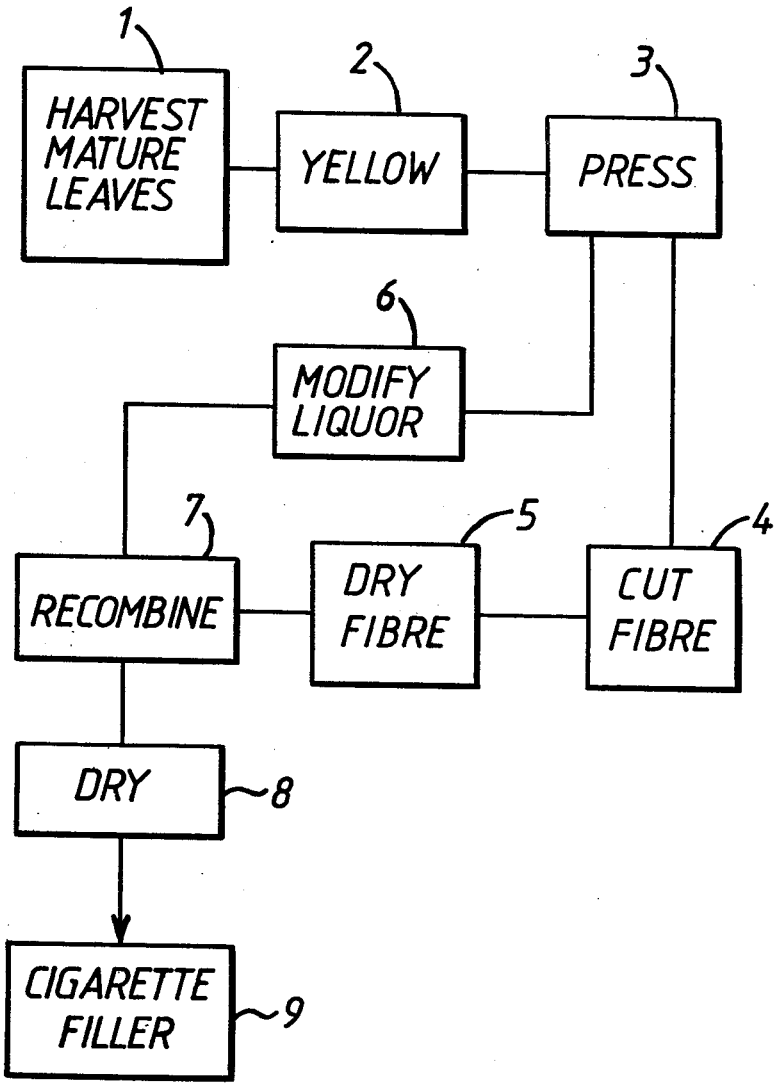
1
HARVEST MATURE LEAVES
2
YELLOW
3
PRESS
6
MODIFY LIQUOR
7
RECOMBINE
5
DRY FIBRE
4
CUT FIBRE
DRY
8
CIGARETTE FILLER
9

TOBACCO PROCESSING

BACKGROUND OF THE INVENTION

1. Field of the Invention

This invention relates to the treatment of tobacco.

2. Description of the Prior Art

Numerous processes have been proposed for the treatment of tobacco in order to obtain an enhanced tobacco product. United Kingdom Specification No. 15,280/08 describes a process, intended to improve the quality of a tobacco, in which the tobacco in green condition is impregnated with juice expressed from green leaves of a superior tobacco and the juice-impregnated tobacco is heated. Before it is applied to the tobacco to be improved, the juice may be allowed to ferment.

According to a tobacco-treatment process disclosed in U.S. Pat. No. 3,500,834, tobacco leaves with a high moisture content are frozen as soon as possible after being harvested, preferably within 6 to 8 hours. The frozen tobacco is then thawed and dried. The removal of water from the thawed tobacco may be assisted by pressing. Tobacco subjected to this process is said to have a reduced alkaloid content.

A process alleged to improve the burning properties of tobacco and to provide other advantages is described in U.S. Pat. No. 3,616,801. The tobacco is contacted with water to obtain an aqueous tobacco extract, the extract is treated to reduce the ion content thereof and the treated extract is recombined with the tobacco from which it has been extracted.

A process claimed to result in cured tobacco of altered composition is the subject of U.S. Pat. No. 3,845,774. Yellowed tobacco leaves are cut into small pieces and are then homogenised in a blending or grinding machine. The homogenised tobacco is incubated to effect curing, after which it is dried. In order to use the resultant particulate tobacco in cigarettes, it would be necessary to subject it to a sheet or filament reconstitution process, for example a reconstitution process of the "paper" type.

It is an object of the present invention to provide an improved tobacco-treatment process by use of which an advantageous tobacco product may be obtained in economic fashion, whilst recourse to sheet or filament reconstitution is avoided.

SUMMARY OF THE INVENTION

The invention provides a tobacco-treatment process wherein cell sap is mechanically expressed from yellowed, substantially undried, tobacco-leaf material, the fibrous material remaining after the expression is impregnated with said cell sap or with parts of components of said cell sap or with cell sap expressed from other yellowed, substantially undried, tobacco leaf material, and the sap-impregnated leaf material is dried.

DETAILED DESCRIPTION OF THE PREFERRED EMBODIMENT

For carrying out the process, the tobacco leaves are preferably harvested in a fully developed and mature state. They may be at least partly yellow when harvested, possibly having been yellowed by the application of a known yellowing agent to the growing tobacco plants. Yellowing may take place, or be completed, by heaping the leaves in piles in an enclosed atmosphere, suitably of a relative humidity of 70% or more and a temperature of about 20°–40° C. The piles should be checked at intervals to ensure that spontaneous heating therein does not subject any of the leaves to unduly high temperatures. The piles may be re-made a number of times to ensure an even yellowing of the leaves. Ethylene gas may be introduced into the atmosphere to promote the yellowing process.

As an alternative to heaping the tobacco leaves in piles, they may be hung in racks in a similar atmosphere.

The yellowing process is usually completed within a period of 24–72 hours.

It is important that although the tobacco-leaf material is yellowed, and preferably substantially fully yellowed, the leaf material should not be permitted to become fully cured. The moisture content of fully yellowed but non-cured tobacco leaves is in the region of 70–90% by weight.

The cell sap may be expressed from the yellowed leaves by use of a press similar to a cider press, by one or more roller presses or by an archimedean screw press.

Before the leaf material is fed to such cell-sap expressing press means, the leaf material may be cut in a tobacco-cutting machine of the well known type in which the tobacco is formed under pressure into a cheese. Any juice expressed in the cutting-machine is collected. Alternatively, prior to being pressed, the yellowed leaves are cut into strands, for example in a vegetable-strand cutter, without being subjected to sap-expressing pressure during the cutting process. In either case the cutting may take place after the implementation of a stem removal stage. If, before the cell sap expressing stage, the tobacco leaves are not subjected to a cutting step resulting in filler size tobacco pieces, they may be so subjected after the expressing stage.

If roller pressing is employed to express the cell sap, a first-stage press may be operted to crush the leaf mid ribs and a second-stage press to express cell sap from the lamina portions of the leaves. By such a procedure, cell sap from the mid ribs, expressed in the first stage, is obtainable separately from cell sap mainly from the lamina portions of the leaves. In order to obtain an extraction of cell sap at 50% or more of the original leaf weight, up to six or even more rolling stages may be required.

In addition to the mechanical expression of cell sap from the yellowed tobacco leaf material, cell sap may be removed by washing the leaf material using water or other suitable solvent.

The tobacco-treatment process of the invention may be operated for the production of a tobacco product which is selectively modified with respect to one or more of a large number of characteristics as compared with tobacco of the same type which has been subjected to a conventional curing process. Thus, for example, a tobacco product having a reduced content of a specified component may be produced, if the component is present in the expressed cell sap liquor, merely by adding back to the fibrous leaf material less than the full quantity of cell sap expressed therefrom. Such expedient may for example be utilised to produce tobacco having a reduced content of an alkaloid, nicotine for example, or of a sugar or other carbohydrate, glucose for example. As will be appreciated, not only will the content in the tobacco of the specified component be lower, but the content of other components may also be thereby reduced. Thus it is preferable to resort to an alternative procedure in which the component in question is removed from the liquor by an appropriate fractionating process. Other tobacco components which may be removed from the cell-sap liquor include inorganic compounds such as nitrates, high molecular weight compounds such as proteins and polyphenols, and polysaccharides such as starch. A fractionating process, centrifuging for example, may be employed to remove substantially all of the solid fraction of the liquor.

It is also possible to enhance the qualities of the tobacco product by introducing thereto substances not originally present therein or present at an undesirably low level only. Included among such substances are alkaloids and sugars. Conveniently such substances can be added to the cell-sap liquor. An antioxidant may advantageously be added to the tobacco-leaf material prior to the pressing stage and/or to the cell-sap liquor to inhibit oxidative changes. A metabisulphite, potassium metabisulphite for example, would provide a suitable antioxidant.

Desired chemical or biochemical changes may be induced in the cell-sap liquor. Thus for example, enzymes may be added thereto. Amongst enzymes suitable for the purpose are proteases, amylases and pectinases.

If it is required to add the cell sap liquor to the pressed leaf material after a considerable delay from the pressing stage, the leaf material should be dried sufficiently to render it chemically and biologically stable. Cell sap liquor can be held in a stable condition by sufficiently lowering its temperature, e.g. to −5° C. or lower.

The accompanying flow diagram illustrates, by way of example, one procedure by which a tobacco-treatment process in accordance with the invention may be performed.

Stage 1 in the diagram represents the harvesting of mature green leaves, according to the customary priming method, from growing tobacco plants. In Stage 2, the whole leaves are then pile yellowed as explained above and in Stage 3, are pressed in a cider-type of press to express up to about 80% of the cell sap from the leaves. In Stage 4, the remaining leaf fibre is cut in a tobacco-cutting machine to cigarette filler size and the cut fibre is force-dried in Stage 5 in a hot air dryer to a moisture content of about 5%. The cell-sap liquor expressed at Stage 4 is modified at Stage 6 in any required manner by removal of undesirable components and/or the addition of selected substances. It may also be diluted or concentrated as required.

If the cell-sap liquor is to be concentrated, to reduce its volume for transportation, for example, suitable concentration processes may include evaporation, reverse osmosis and freeze drying. In Stage 7, the cut dried fibrous portion of the tobacco is recombined with the modified cell-sap liquor by spraying the latter onto the former. In Stage 8, the product of Stage 7 is dried for shipment to a cigarette-manufacturing facility, where it is reconditioned to render it suitable for handling as cigarette filler (Stage 9).

The leaves may be cut before being subjected to the pressing Stage 3. If pre-pressing cutting is not sufficient to reduce the leaves to filler size, a post-pressing cutting stage or stages may be required. Post-pressing cutting need not necessarily take place before the fibre drying Stage (5): it could take place after the fibre-drying stage and before the recombining Stage 7 or after the recombining stage and before the drying Stage (8).

If required, the cigarette filler may be subjected to an expansion process.

The following are examples of procedures for carrying out the invention:

EXAMPLE 1

Virginia tobacco leaves were harvested from field grown plants when judged ready for curing. 34.3 kg wet weight of leaves from the middle of the plant (3rd priming) were harvested and pile yellowed at room temperature under plastic sheeting. When substantially all the original green colour had disappeared, the leaves were re-weighed. Weight loss during this phase was 1 kg. The leaves were pressed by passing sequentially through 6 rubber covered rollers and the cell-sap liquor was collected in a plastic vessel. The pressed leaves were air-dried and the liquor was stored by deep-freezing until subsequent analysis. 10.35 kg liquor and 5 kg air-dried leaf residue were obtained.

EXAMPLE 2

The procedure was as in Example 1 except that 35.8 kg leaves were harvested from the next plant position (4th priming). There was a 5 kg weight loss in yellowing. Pressing resulted in 5.1 kg of liquor and 5.5 kg air-dried leaf residue.

EXAMPLE 3

The procedure was as in Example 1 except that 62.4 kg leaves from the 5th priming at the top of the plant were harvested. Weight loss in yellowing was 7 kg. 14 kg of liquor and 9.1 kg air dried leaf residue were obtained.

The results of analyses of the leaf residues and of the cell-sap liquors for Examples 1–3 are given in the Table below.

| | % Nicotine Alkaloids | | % Total Sugars | | % Total Nitrogen | | % Protein Nitrogen | |
|---|---|---|---|---|---|---|---|---|
| | Leaf Residue | Liquor | Leaf Residue | Liquor | Leaf Residue | Liquor | Leaf Residue | Liquor |
| 3rd Priming | 1.41 | 0.08 | 15.8 | 4.3 | 1.6 | 0.2 | 0.9 | 0.08 |
| 4th Priming | 1.69 | 0.18 | 22.5 | 6.3 | 1.7 | 0.3 | 0.8 | 0.05 |
| 5th Priming | 2.37 | 0.23 | 16.1 | 3.9 | 2.2 | 0.35 | 1.1 | 0.05 |

EXAMPLE 4

Cell-sap liquors from Examples 1–3 were mixed in appropriate ratios and centrifuged to remove insoluble debris. The supernatant liquid was rotary evaporated to one quarter of its original volume and added back to a blend of the leaf residues by spraying.

EXAMPLE 5

The procedure was as in Example 4 but the combined supernatant liquors were freeze-dried resulting in 13.8% solids being recovered. The solids were dissolved in a minimum quantity of water and sprayed onto the original leaf residue.

EXAMPLE 6

The procedure was as in Example 5 except that instead of adding water to the solids, the solids were ground to a powder which was then applied in a dry state to the leaf residue.

What is claimed is:

1. A tobacco-treatment process, wherein cell-sap is mechanically expressed from yellowed, substantially undried, tobacco-leaf material, fibrous material remaining after the expression is impregnated with at least a part of cell-sap expressed from yellowed, substantially undried, tobacco-leaf material, and the sap-impregnated leaf material is dried.

2. A process according to claim 1, wherein the tobacco-leaf material comprises leaves harvested in a fully developed and mature state.

3. A process according to claim 1, wherein the leaves of the tobacco-leaf material are at least partly yellow when harvested.

4. A process according to claim 1, wherein the leaves of the tobacco-leaf material have been yellowed by the application of a yellowing agent to growing tobacco plants.

5. A process according to claim 1, wherein yellowing is effected at least in part by keeping the harvested leaves in an enclosed atmosphere.

6. A process according to claim 5, wherein said atmosphere has a relative humidity of at least 70% and a temperature in the range of 20° to 40° C.

7. A process according to claim 5, wherein ethylene gas is introduced into said atmosphere to promote the yellowing.

8. A process according to claim 1, wherein the tobacco-leaf material is cut before being subjected to cell-sap expression.

9. A process according to claim 1, wherein cell-sap expression is effected in at least two stages, namely a first stage in which mid ribs of the leaves of the tobacco-leaf material are crushed and a second stage in which the cell-sap is expressed from lamina portions of the said leaves.

10. A process according to claim 1, wherein said fibrous material is impregnated with a quantity of cell-sap less than the quantity of cell-sap expressed from said tobacco-leaf material.

11. A process according to claim 1, wherein, before said fibrous material is impregnated with the cell-sap, at least a part thereof is subjected to a fractionating process to reduce the content therein of at least one component of the group consisting of nicotine, other alkaloid, nitrate, other inorganic compound, protein, polyphenol, other high molecular weight compound, glucose, starch and other carbohydrate.

12. A process according to claim 1, wherein, before the cell-sap is expressed frm the tobacco-leaf material, an antioxidant is added to said material.

13. A process according to claim 1, wherein an antioxidant is added to at least part of the cell-sap.

14. A process according to claim 1, wherein an enzyme is added to at least a part of said cell-sap.

15. A tobacco product obtained by treatment of tobacco-leaf material with cell-sap, by a process in accordance with claim 1.

* * * * *